United States Patent [19]

Amphoux

[11] Patent Number: 4,603,619

[45] Date of Patent: Aug. 5, 1986

[54] FLUE TERMINAL GAS EXTRACTOR

[76] Inventor: André Amphoux, 12, rue Jules César, 75012 Paris, France

[21] Appl. No.: 464,890

[22] Filed: Feb. 8, 1983

Related U.S. Application Data

[63] Continuation-in-part of Ser. No. 227,676, Jan. 23, 1981, abandoned.

[30] Foreign Application Priority Data

Jan. 25, 1980 [FR] France ..... 80 01636

[51] Int. Cl.[4] ..... F23L 17/02

[52] U.S. Cl. ..... 98/59; 98/78

[58] Field of Search ..... 98/58, 60, 67, 78, 83, 98/59

[56] References Cited

U.S. PATENT DOCUMENTS

| | | | |
|---|---|---|---|
| 211,872 | 2/1879 | Van Noorden | 98/83 |
| 3,347,147 | 10/1967 | Howard | 98/78 |
| 3,382,792 | 5/1968 | Howard | 98/78 |
| 3,788,072 | 1/1974 | Burger | 98/59 X |
| 3,853,042 | 12/1974 | Tobiasson | 98/78 |
| 4,184,417 | 1/1980 | Chancellor | 98/58 |
| 4,206,693 | 6/1980 | Mitchell | 98/60 X |

*Primary Examiner*—William E. Tapolcai

*Attorney, Agent, or Firm*—Robert E. Burns; Emmanuel J. Lobato; Bruce L. Adams

[57] ABSTRACT

A flue terminal extractor mounted at the discharge end of a flue comprises a lower unit mounted coaxially on the flue and an upper unit coaxial with and spaced from the lower unit. The lower unit comprises a downwardly facing frustoconical lower base having a central opening through which the flue extends and an upwardly facing frustoconical lower bonnet joined at its outer periphery with the outer periphery of the lower base and having a central opening in which the flue terminates. The upper unit comprises a downwardly facing conical upper base and an upwardly facing conical upper bonnet. The area of the free space for outward flow of gas between the lower unit and the upper unit is at least equal to the cross sectional area of the flue.

11 Claims, 5 Drawing Figures

FLUE TERMINAL GAS EXTRACTOR

REFERENCE TO PRIOR APPLICATION

This application is a continuation in part of my application Ser. No. 227,676, filed Jan. 23, 1981, now abandoned.

FIELD OF INVENTION

The present invention relates to an improved flue terminal for the disposal of fluid gases and particularly for the disposal of gases or smoke from a chimney or any other outlet which is approximately vertical, and in particular to an installation for the high pressure discharge of gases into the atmosphere.

BACKGROUND OF THE INVENTION

Installations for this purpose are already known and are used for example, for the discharge of vapours and smoke from central heating plants into the atmosphere. These installations have a certain efficiency, but they use part of the energy produced by the plant. Furthermore, they require a considerable amount of maintenance.

In the case of chimneys for the discharge of gases into the atmosphere in a natural manner, that is without using evacuation machines such as a fan, static ventilators are used mounted on the outlet orifice of the chimney.

There already exist flue terminals consisting of a lower unit and of a superposed upper unit that are both hollow, circular, co-axial and rigidly fixed to each other some distance apart. The lower unit of the flue terminal comprises a lower base and a lower bonnet, shaped approximately like a truncated cone, linked rigidly to each other by their large common base, and through which passes a co-axial pipe rigidly fixed to them both and which opens onto the area lying between the upper and the lower units by means of an outlet through which the gases flow. The upper unit consists of an upper base and an upper bonnet both approximately conical in shape, rigidly fixed to each other by their large common base.

These flue terminals first purpose is to faciliate the removal of fluid gases from the outlet of the conduit extending from the chimney above which the device is fitted.

These flue terminals are so designed as to make use of the sucking action of a Venturi tube. The pipe through which the fluid gases are fed opens onto the space which lies between the lower and the upper units of the flue. The flow of wind in the space which lies between the lower and upper units is similar to that of a Venturi tube, and fluid gases are drawn from the point of outlet of these gases.

These flue terminals are generally speaking efficient when there is a wind blowing but their design does not take into account the free passage area which lies between the lower and upper units, namely the free flow section peripheral to the gases which are to be disposed of. However, this free passage area plays a very important part particularly when the flue terminal is not subjected to the action of the wind, in calm weather in fact. When this is the case, a very important pressure loss occurs which decreases the speed of the vertical ejection of the gases to be removed.

Existing flue terminals do indeed protect from rain the outlet of fluid gas and prevent rain from entering the flue. However they are not designed to protect the outlet from rain falling at certain angles to the vertical axis of the conduit extending from the chimney. Neither are they designed to operate when the wind in blowing at an ascending or descending angle from the horizontal axis.

In other respects these flue terminals are not designed to effect a fixed nominal capacity of fluid gases actually disposed of whatever the speed of the wind may be. However, it has been found that where the gas undergoes a forced flow for example owing to the presence of a powerful fan at the foot of the chimney, or when the gas is the exhaust gas of an engine, the suction effect of a static ventilator is no longer desired as it can no longer have a notable result in view of the fact that the pressure of the gas resulting from its forced flow is considerably greater than the pressure drop provided by the static ventilator.

Experiments carried out by the applicant have shown in a completely unexpected and surprising manner that a device which overall has a general shape similar to that of a static ventilator may, when fitted to the orifice for the outlet into the atmosphere of a forced flow of a gas, fulfil a new function, the effect of which is to promote the penetration of the gas into the ambient atmosphere.

The applicant has ascertained that a stream of gas under pressure and at high speed undergoes very powerful deceleration when it reaches the outlet orifice of a pipe in order to penetrate a medium such as the atmosphere. From the outlet orifice, the stream spreads out and the speed and pressure of the gas decrease as it moves away from the orifice until it ultimately attains the speed and pressue of the ambient atmosphere and mixes with the latter. A considerable pressure drop which is equivalent to a counter-pressure occurs at the outlet orifice. This pressure drop is due, on the one hand, to a transverse contraction of the stream and, on the other hand, to turbulence of the medium which this stream penetrates. The result of this is that the effective and useful speed and pressure are lower than those provided by an evacuation machine such as the fan, that is the effective performance of this machine is decreased.

SUMMARY OF THE INVENTION

It is an object of the present invention to provide a flue terminal in which the above mentioned problems are obviated or mitigated.

The invention proposes a new and inventive application of static ventilators for the discharge of gases into the atmosphere including installations for the discharge of a gas under pressure and at high speed. The applicant has also surprisingly found, after research, that if several pieces of apparatus according to the invention are placed close to each other and associated with several pipes, their effect is increased and not lessened as one might have expected, as a result of their arrangement.

Such a result can be explained by the fact that each piece of apparatus facilitates the creation in the atmosphere of a stream which will pass through an adjacent piece of apparatus and further reduce the pressure drop for this apparatus, the effect of which will be increased.

It is thus advantageous to arrange the various pieces of apparatus close to each other, when this is possible.

According to the present invention there is provided an installation for discharging a gas by forced flow under pressure and at high speed into the atmosphere comprising an evacuation machine, a discharge pipe associated with the evacuation machine and defining an orifice, apparatus for the evacuation of the gas associated with the orifice of the discharge pipe downstream of the evacuation machine, this apparatus being in one piece without moving parts and operable as a result of its association with the pipe and its presence in the atmosphere, and the apparatus comprising at least one wall defining at least one space in the form of a venturi, said orifice of the pipe being located in the immediate vicinity of the narrowest region of said venturi.

According to the present invention there is provided a flue terminal comprising a lower unit and an upper unit forming a Venturi tube that are both hollow, circular, superposed, and co-axially fixed to each other at a certain distance to each other, the lower unit consisting of a lower bonnet through which passes a flue which opens onto the space between the lower unit and the upper unit by means of an outlet for fluid gases and the upper unit consisting of an upper base which features a section of free passage of the fluid gases to be disposed of between the lower unit and the upper unit at least equal to section Sd of the outlet of the flue, and means for protecting the outlet of the flue from rain and means for increasing the height H2 of the area of final negative pressure in relation to the height H1 of the initial negative pressure.

Preferably, the means by which a section of free passage for the fluid gases to be disposed of is made at least equal to that of the section of the outlet of the pipe through which the gases to be disposed of are fed comprises the upper base of the upper unit which has an approximately pseudo-conical shape, the generating lines forming with the longitudinal axis of the appliance an angle ($\alpha$) of less than 75°. This angle should preferably be between 45° and 75°.

Preferably, the means for protecting the outlet of the pipe from rain comprises the upper unit which should preferably have a diameter D of 2 to 3.5 times the diameter d of this outlet.

Preferably the diameter D of the upper unit should be between 2.2 times the diameter d of the outlet and 3.1 times the diameter d of the outlet.

Preferably, the means for increasing the height of the area of final negative pressure in relation to the height of the initial negative pressure comprises the upper bonnet of the upper unit and the lower base of the lower unit, the generating lines forming an angle $\gamma$ of between about 10° and 60°.

The apparatus for use in the installation, with respect to known devices, has the advantage of not comprising any moving parts, not consuming energy, and of being of simple manufacture. Furthermore, all things being equal, it facilitates a considerable reduction of the power for the evacuation machine. This apparatus may be used for fixed installations (engines, boilers, painting installations etc.) or movable installations (in particular motor vehicle engines).

BRIEF DESCRIPTION OF DRAWINGS

The invention will now be described by way of example with reference to the accompanying drawings, in which.

DESCRIPTION OF PREFERRED EMBODIMENTS OF THE INVENTION

Figure 1:
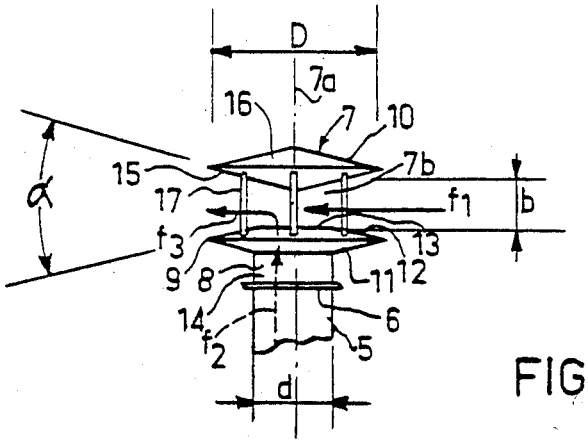
FIG. 1 is a schematic elevational view of a terminal gas extractor in accordance with the invention.
Figure 2:
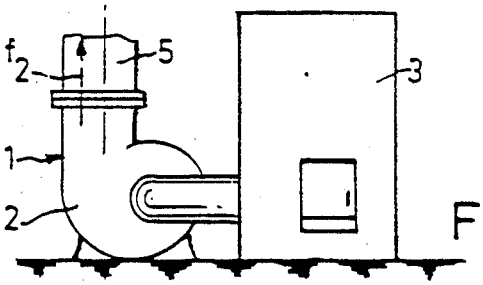
FIG. 2 is schematic elevational view of an installation with which the extractor of FIG. 1 is used.

A fixed or movable installation 1 for the discharge into the atmosphere of a gaseous fluid under pressure and at high speed, in particular with a forced flow, comprises, as shown in FIGS. 1 and 2 an evacuation machine 2 assciated with a source 3 of gas or gaseous fluid to be discharged via a suction pipe 4 and to which a discharge pipe 5 is connected by its upstream orifice.

The source 3 may have numerous forms: it may be a fixed boiler, painting installtion, motor vehicle engine (in which case the discharge pipe 5 is the exhaust pipe of the said vehicle).

According to the invention, the discharge pipe 5 is equipped at its downstream orifice 6 with a device 7 for the evacuation of the gaseous fluid.

According to the invention, the evacuation device 7 is in one piece, normally devoid of moving parts, operating by virtue of its simple association with the pipe 5 and its presence in the ambient atmosphere, i.e., in particular, without consuming external energy. The device 7 essentially comprises at least one wall defining at least one space **7*b* in the form of a venturi, the downstream orifice 6** being located at the point of or in the immediate vicinity of the narrow region of said venturi.

In a non-limiting embodiment, a device of this type according to the invention comprises a pipe 8 passing through an upstream member 9, in particular a hollow member, to which it is connected. A downstream member 10, in particular a hollow member, which is rigidly connected to the upstream member 9 is at a distance from the upstream member 9. The upstream member 9 and downstream member 10 are coaxial with respect to the axis **7*a*. In the non-limiting embodiment illustrated in the drawing, the axis 7*a*** is vertical. In other embodiments, this axis may be horizontal or inclined (in the case of a vehicle).

The upstream member 9 comprises an upstream base 11 and an upstream top 12, each of the latter having the general shape of a truncated cone or pseudo truncated cone, rigidly connected to each other by their two common major bases of circular contour. These common bases are located in an upstream plane at right angles to the axis **7*a*. This plane is a general plane of symmetry of the upstream member 11. The pipe 8 passes coaxially through the upstream base 11 and the upstream top 12, to which it is rigidly connected by any suitable means, for example by welding and opens through an orifice 13 into the space 7*b* forming a venturi between the two members 9, 10 which define the said wall, without substantially projecting into the latter. When the device 7 is fitted at the location of the downstream orifice 6, the gaseous fluid is discharged through the orifice 13**.

Adjacent the upstream base 11, the pipe 8 comprises an extension 14 provided with connecting means, allowing the pipe 8 to be rigidly connected to the discharge pipe 5 at its downstream orifice 6.

The downstream member 10 comprises a downstream base 15 and a downstream top 16, each of the latter having the general shape of a cone or pseudo cone, thus each being provided with a free end part of pointed shape. The downstream base 15 and the downstream top 16 are rigidly connected to each other along their two common major bases of circular or pseudo ciruclar contour. These common bases are located in a downstream plane at right angles to the axis *7a*. This plane is a general plane of symmetry of the downstream member 10 and is parallel to the plane of symmetry of the upstream member 9.

The upstream member 9 and downstream member 10 are rigidly connected to each other by means of a plurality, and in particular by means of three, connecting members 17, which are preferably uniformly distributed about the axis *7a*. These members 17 are preferably located in radial planes passing through the axis *7a*. For example, the members 17 may be small pillars parallel to the axis *7a* as shown diagrammatically, or even brackets etc.

The airstream of the ambient atmosphere blows in the general direction of arrow f1, at right angles or at least approximately at right angles to the axis *7a* either naturally or in a forced manner (resulting from the presence of deflection means and/or fans or the like and/or means suitable for guiding a stream of this type) between the upstream member 9 and downstream member 10.

The gaseous fluid is discharged into the ambient atmosphere under pressure and at high speed owing to the action of the machine 2, via the discharge pipe 5, in the direction of arrow f2 parallel or at least substantially parallel to the axis *7a*. The ambient airstream and the stream of gaseous fluid combine to form a mixed stream, initially in the direction of arrow f3 at right angles or at least substantially at right angles to the axis 7 (FIG. 1).

The invention also relates to the application of the device 7 which has been described to an installation such as 1, on the one hand, all things being equal, in order to increase the efficiency of the machine 2 and, on the other hand, to promote the penetration of the gaseous fluid into the atmosphere. These functions have an increased effect if the device 7 and in particular the orifice 6 is provided with means for increasing the venturi effect.

Figure 3:
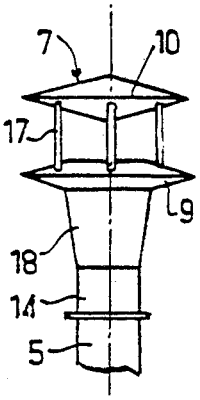
FIG. 3 is a schematic elevational view of a modification of the extractor of FIG. 1.

In the embodiment illustrated in FIG. 3, the device 7 comprises a diffuser 18 in the form of a section of pipe of frustoconical shape, the small opening of which is connected to the extension 14 and the large opening of which to the upstream member 9.

Figure 4:
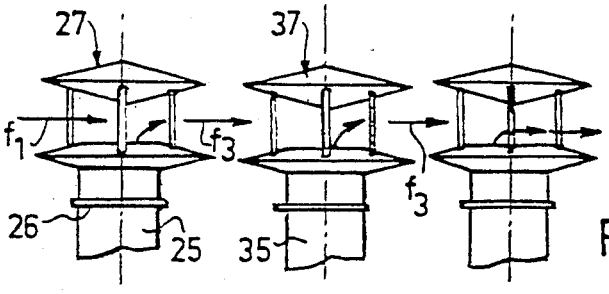
FIG. 4 is a schematic elevation showing several extractors in combination.

An installation for the discharge of gaseous fluid into the atmosphere may be a multiple installation, in particular it may comprise a plurality of discharge pipes 25,35 etc., (FIG. 4) which are independent of each other as regards the sources of fluid and/or the respective evacuation machines or on the contrary are associated in all or part with the same source and/or machine. In this case, according to the invention, these pipes 25,35 etc are arranged close to each other at least at their downstream end in order that the devices according to the invention 27,37 etc., which are associated with them, are as close as possible to each other and in facing relationship in order to be able to influence each other in a reciprocal manner. The mixed stream flowing in the direction of arrow f3 coming from the device 27 increases the efficiency of the adjacent device and so on.

The following definitions will be useful (referring to FIG. 1) $\gamma$: angle of opening of the space *7b* forming a venturi; D: outside dimension of the device 7 according to the invention in particular outer diameter of the upstream member 9 and downstream member 10; d: inner diameter of the orifice 13; b: distance between the orifice 13 and, at right angles to the edge of the latter, the base 15 of the downstream member 10.

In a possible non-limiting embodiment of the invention, we have the following: $\gamma$ angle of opening of the space *7b* forming a venturi; D: outside dimension of the device 7 according to the invention in particular outer diameter of the upstream member 9 and the downstream member 10; d: inner diameter of the orifice 13; b: distance between the orifice 13 and, at right angles to the edge of the latter, the base 15 of the downstream member 10.

In a possible non-limiting embodiment of the invention, we have the following:

$\gamma$ is greater than 0 degrees and less than or equal to 180 degrees b/d is greater than 0 and less than or equal to 3

D/d is greater than 1 and less than 3

In a preferred non-limiting embodiment, we have the following $\gamma$ is greater than 0 degrees and less than or equal to 90 degrees b/d is greater than or equal to 0.3 and less than or equal to 1

D/d is greater than or equal to 2 and less than or equal to 2.5.

Figure 5:
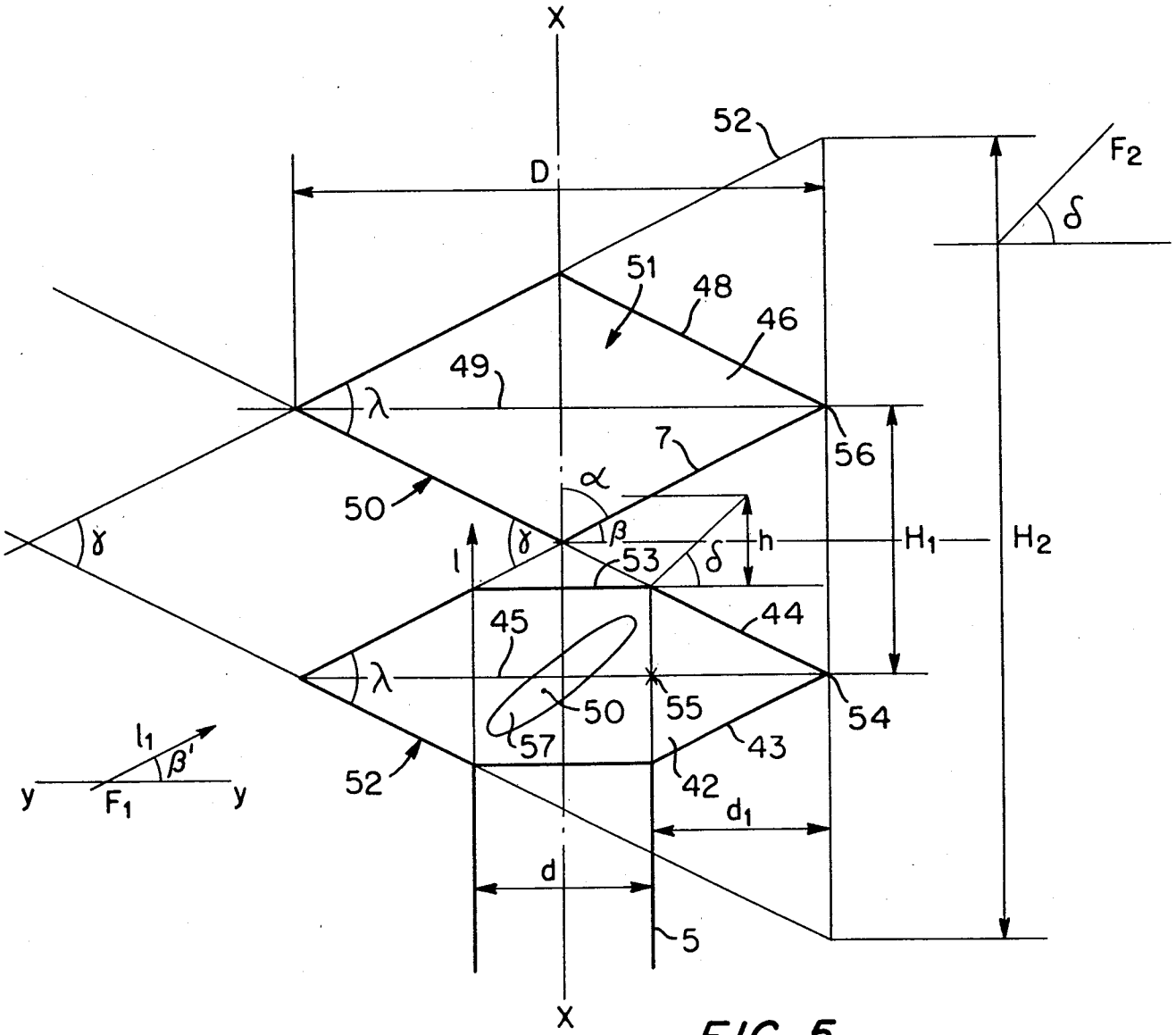
FIG. 5 is a schematic view illustrating parameters of an extractor in accordance with the invention.

The parameters of an extractor in accordance with the invention are illustrated in more detail in FIG. 5 in which there is shown a flue terminal gas extractor comprising a combination of a flue 41, a hollow circular lower unit 42 to which it is fixed and an upper unit 46.

The lower unit 42 consists of a lower base 43 and a lower bonnet 44, both of which have a psuedo-conical shape on the axis XX, fixed rigidly to each other by two large common bases 45 of common contour. The flue 41 extends co-axially through the lower base and the lower bonnet.

The upper unit 46 comprises an upper base 47 and an upper bonnet 48 each having a pseudo-conical shape. These two units are linked by a large base of circular contour. It should be noted that the lower base 43 and the lower bonnet 44 have the shape of a truncated cone and the diameter of the smaller base of these truncated cones is very nearly equal to the diameter d of the flue 41.

The flue terminal further comprises means 50 for ensuring that there is a section of free passage for fluid gases to be disposed of between the lower unit 42 and the upper unit 46 at least equal to the section Sd of the outlet of the flue 41 through which the gases to be disposed of emerge and also, means 51 for protecting the outlet of the flue from rain and means 52 for increasing the height H2 of final negative pressure in relation to the height H1 of initial negative pressure.

The means 50 for ensuring that there is an area of free passage for fluid gases to be disposed of between the lower unit 42 and the upper unit 46 at least equal to the section Sd of the outlet of the flue 41 through which are fed the gases to be disposed of consists of the upper base 47 of the upper unit 46, which is approximately conical in shape, and the generating lines of which form with the longitudinal axis XX of the device an angle $\alpha$ which is less than 75°.

This is because the wind according to its direction, may have a more or less favorable effect on the draught.

When the wind blows upwards, as indicated by the arrow F1, forming an angle $\beta'$ in relation to an axis YY perpendicular to the longitudinal axis XX of the device the wind increases the draught.

If there is no wind and if the rate at which the gases to be disposed of is expressed as a vector parallel to axis XX preferably vertical, of a length l, the flow rate of the fluid gas per second is equal to section Sd.l.

If the wind should blow at an ascending angle, as for example indicated by the arrow F1, fluid gases will emerge from the device along the resultant of the vertical vector of length l and the flow rate of the gases to be disposed of will be greater.

On the other hand, if the wind blows in a perpendicular direction to the longitudinal axis XX of the device, it is necessary, in order to ensure a flow of fluid gases, for the area of free passage of fluid gases between the lower unit 42 and the upper unit 46 to be at least equal to section Sd of the outlet of the flue 41.

By "Section Sh of free passage for the fluid" is meant the surface of the cylindrical area about axis XX of revolution, on a circular base comprised between the lower unit 42 and the upper unit 46 in continuation of flue 41. This free section Sh is thus a cylinder of revolution of height h being comprised between the circular base 53 of the lower bonnet 44 and the upper base 47 at right angles to the flue 41. The diameter of the circular base is d. This free section is decreased by the surface occupied by the wind and if the wind occupies half the volume, then the free surface is decreased by half. One can therefore express the section for the free passage of fluid gases as being equal to $\frac{1}{2}.\ 2\pi.\ (d/2)h$.

On the other hand, the section of the outlet of the pipe is equal to $Sd=\pi.(d/2)^2$: Hence $h=d/4$. Consequently, the tangent of angle $\beta$ formed by the generating line 47 of the upper base 47 and the axis YY perpendicular to the longitudinal axis XX is equal to $\frac{1}{2}$. Thus $tg\beta=\frac{1}{2}$ and angle $\beta=26.5$.

However, through the use of this device, the fee section Sh which is of course equal to Sd can be increased to 2 Sd by increasing the distance h to 0.5d, increasing therefore the distance between the lower unit 42 and the upper unit 46. Section Sh can be increased in relation to Sd by increasing h to 0.6d.

Angle $\beta$ lies between 15° and 45°. Angle $\alpha$ which is complementary to angle $\beta$ and which is formed by axis XX and the generating line 47 of the upper base 47 lies between 75° and 45°.

If the fluid to be disposed of rises at an appreciable rate, and $\beta'$ formed by the direction of the wind in relation to axis YY which is perpendicular with axis XX of the device is an angle more acute than angle $\beta$. Consequently $\beta$ can be deemed to be between 15° and 45°. Angle $\alpha$ formed by the generating line 47 of the upper base 47 of the upper unit 46 and axis XX measures between 45° and 75°. Angle $\lambda$ which is the angle formed by the generating line 48 of the upper bonnet and the generating line 47 of the upper base 47 measures between 10° and 90°. Angle $\lambda$ which is the angle formed by the generating line 47 and the generating line 44 has a bisectrix which perpendicular to the axis XX. This makes it possible to obtain the Venturi effect; its measurements are relative to the measurements given to angle $\delta$.

The means 51 by which the outlet of flue 41 is protected from rain consist of the upper unit, the diameter of which D is less than or equal to 3.5 times the diameter d of the outlet.

If rain falls in the direction indicated by arrow F2 forming an angle $\delta$ with axis YY perpendicular with longitudinal axis XX of the device, and given that we call dl the distance which separates the external edge 54 of the lower unit 42 and the projection of the outlet on axis YY (reference 55 on the diagram), then: $tg\delta=h/d/2$.

Thus, if angle 67 measures 45° and if besides the parameter h is equal to d/2 and if angle $\beta$ is equal to 26.5°, the diameter D is equal to 3d.

If angle $\beta$ is more acute i.e. if it is equal to angle $\beta'$ when the upward rate of the gases to be disposed of is appreciable, and if height h is equal to d/2 in order that the angle $\delta$ be equal to 45°, that is to say in order to give maximum protection from rain to the outlet of flue 41, a smaller diameter D can be considered; it could for example be equal to twice the diameter of flue 41. D can therefore be considered as measuring between 2d and 3.5d.

The means 52 for increasing the height of the area of final negative pressure in relation to the height H1 of the area of initial negative pressure consists of the upper bonnet 48 of the upper unit 46 and the lower base 43 of the lower unit 42, the generating lines 48 and 43 forming an angle $\gamma$ between approximately 10° and 60°.

Height H1 is the distance between the external circular edges 54 of the lower unit 42 and 56 of the upper unit 46. As to the distance H2, this is the distance between the generating lines 52 respectively of the lower base 43 and the upper bonnet 48, this distance being measured along an axis parallel to axis XX.

Preferably, the ration H2/H1 should be approximately 3.

This improved flue terminal makes it possible to channel the wind by re-directing it perpendicularly to the longitudinal axis XX of the flue 41.

A device 57 for regulating the nominal rate of fluid gases disposed of can also be considered. This device consists of a shutter with a pivotal axis 58 which is offset in relation to the centre of its greater diameter. This shutter should preferably be pseudo-circular and not level. This shutter mades it possible to obstruct the flue 41 to a greater or lesser degree according to the speed of the wind. When wind speed is low, the shutter obstructs the flue 41 to a small degree. As the speed of the wind increases, the shutter pivots on its axis which preferably should be perpendicular to the longitudinal axis XX of the device. All other things being equal, the flue 41 is obstructed to a greater extent. The shutter pivots proportionally to the wind speed by means of a return spring with a suitably adjusted pull-back or by means of a counterweight which is more or less heavy in relation to the wind speed.

What is claimed is:

1. A flue terminal gas extractor mounted at the discharge end of a flue and comprising a lower unit and an upper unit coaxial with said lower unit, said lower unit comprising a downwardly facing frustoconical lower base having a central opening through which said flue extends, an upwardly facing frustoconical lower bonnet joined at its outer periphery with the outer periphery of said lower base and having a central opening in which the discharge end of the flue terminates, and said upper unit comprising a downwardly facing conical upper base and an upwardly facing conical upper bonnet joined at their peripheries, and means mounting said upper unit in spaced relation to said lower unit with the distance between the end of said flue and a circular intersection of a projection of said flue with said upper base equal to at least one-fourth the diameter of said flue, said lower bonnet in combination with said upper base comprising venturi means producing an area of negative pressure on the discharge end of said flue upon a generally horizontal flow of air past said extractor, and said lower base in combination with said upper bonnet comprising means for increasing the height of said negative pressure area, said lower unit and upper unit cooperating to prevent back-flow in said flue.

2. A flue terminal gas extractor according to claim 1, in which the distance between the end of said flue and a circular intersection of a projection of said flue with said upper base is between 0.33 and 0.6 times the diameter of said flue.

3. A flue terminal gas extractor according to claim 1, in which the angle of a generatrix of the frusto-conical surface of said lower bonnet with the axis of said flue is substantially equal to the angle of a generatrix of the conical surface of said upper base with the axis of said flue.

4. A flue terminal gas extractor according to claim 3, in which the angle between a generatrix of the frustoconical surface of the lower base and a generatrix of the frustoconical surface of the lower bonnet is substantially equal to the angle between a generatrix of the conical surface of said upper base and a generatrix of the conical surface of the upper bonnet.

5. A flue terminal gas extractor according to claim 1, in which the diameter of said upper unit is between 2.5 and 3.5 times the diameter of said flue.

6. A flue terminal gas extractor according to claim 1, in which the angle between a generating line of said conical upper base and the longitudinal axis of said extractor is between 45° and 75°.

7. A flue terminal gas extractor according to claim 1, in which the angle between a generating line of the frusotonical lower base and a generating line of the conical upper bonnet is between 10° and 60°.

8. A flue terminal gas extractor according to claim 1, further comprising in said flue upstream of said lower unit means for regulating the nominal rate of flow of gases in the flue.

9. A flue terminal gas extractor according to claim 8, in which said means for regulating the nominal rate of flow comprises an inclined non-circular oval shutter pivoted about an axis approximately perpendicular to the longitudinal axis of said extractor and offset with respect to the larger diameter of said shutter.

10. A flue terminal gas extractor according to claim 1, in which each of said units is symmetrical with respect to a central plane perpendicular to the common axis of said units, the planes of symmetry of the respective units being parallel to one another.

11. A flue terminal gas extractor mounted at the discharge end of a flue and comprising a lower unit and an upper unit coaxial with said lower unit, said lower unit comprising a downwardly facing frustoconical lower base having a central opening through which said flue extends, an upwardly facing frustoconical lower bonnet joined at its outer periphery with the outer periphery of said lower base and having a central opening in which the discharge end of the flue terminates, and said upper unit comprising a downwardly facing conical upper base and an upwardly facing conical upper bonnet joined at their peripheries, and means mounting said upper unit in spaced relation to said lower unit with the distance between the end of said flue and a circular intersection of a projection of said flue with said upper base equal to at least one-quarter the diameter of said flue, the angle between a generatrix of the frustoconical surface of said lower bonnet and the axis of said flue being substantially equal to the angle between a generatrix of the conical surface of said upper base with the axis of said flue, each of said units being symmetrical with respect to a central plane perpendicular to the axis of said flue, the planes of symmetry of the respective units being parallel to one another, the angle between a generatrix of the lower base and a generatrix of the lower bonnet and the angle between a generatrix of the upper base and a generatrix of the upper bonnet being of the order of 30° to 35°, the outer diameter of said upper unit and said lower unit being about 2.5 to 3.5 times the diameter of said flue, and the distance between the end of said flue and a circular intersection of a projection of said flue with said upper base being 0.33 to 0.6 times the diameter of said flue, whereby said upper unit and said lower unit cooperate to produce an area of negative pressure on the discharge end of said flue upon a generally horizontal flow of air past said extractor and to prevent back-flow in said flue.

* * * * *